US008770436B2

(12) United States Patent
Ochi

(10) Patent No.: US 8,770,436 B2
(45) Date of Patent: Jul. 8, 2014

(54) VENDING MACHINE-INTEGRATED TABLE

(75) Inventor: Yasushi Ochi, Izumisano (JP)

(73) Assignee: BLD Oriental, Ltd., Izumisano-shi (JP)

( * ) Notice: Subject to any disclaimer, the term of this patent is extended or adjusted under 35 U.S.C. 154(b) by 135 days.

(21) Appl. No.: 13/382,022

(22) PCT Filed: Apr. 13, 2010

(86) PCT No.: PCT/JP2010/002657
§ 371 (c)(1),
(2), (4) Date: Feb. 2, 2012

(87) PCT Pub. No.: WO2011/016164
PCT Pub. Date: Feb. 10, 2011

(65) Prior Publication Data

US 2012/0118907 A1 May 17, 2012

(30) Foreign Application Priority Data

Aug. 6, 2009 (JP) ..... 2009-198944

(51) Int. Cl.
*G07F 11/00* (2006.01)

(52) U.S. Cl.
USPC ..... 221/155; 221/24

(58) Field of Classification Search
USPC ..... 221/24, 155, 192
See application file for complete search history.

(56) References Cited

U.S. PATENT DOCUMENTS

| | | | | | |
|---|---|---|---|---|---|
| 2,334,094 | A * | 11/1943 | Hickey | 221/192 |
| 2,397,403 | A * | 3/1946 | Bishop | 221/150 R |
| 2,516,005 | A * | 7/1950 | Kosla | 221/254 |
| 3,608,777 | A * | 9/1971 | Bodoh et al. | 221/129 |
| 5,240,139 | A * | 8/1993 | Chirnomas | 221/2 |
| 5,513,772 | A | 5/1996 | Glaser | |
| 6,791,575 | B2 * | 9/2004 | Abboud | 345/649 |

FOREIGN PATENT DOCUMENTS

| | | | |
|---|---|---|---|
| JP | 3-149006 | A | 6/1991 |
| JP | 7-036707 | Y2 | 8/1995 |
| JP | 9-293166 | A | 11/1997 |
| JP | 10-076069 | A | 3/1998 |
| JP | 10-507552 | A | 7/1998 |
| JP | 2001-167342 | A | 6/2001 |
| JP | 2002-269626 | A | 9/2002 |
| JP | 2004-105470 | A | 4/2004 |
| JP | 2007-004480 | A | 1/2007 |

OTHER PUBLICATIONS

International Search Report of PCT/JP2010/002657, mailing date Jul. 20, 2010.

* cited by examiner

*Primary Examiner* — Timothy Waggoner
(74) *Attorney, Agent, or Firm* — Westerman, Hattori, Daniels & Adrian, LLP

(57) ABSTRACT

A vending machine integrated table with a game function attached to automatically dispense product, or to sell product by causing the product to be acquired through manual operations by the user. The vending machine integrated table is provided with at least a top plate, and a vending machine beneath the top plate. The top plate is provided with one of either a displaying and accepting mechanism for displaying products that can be sold by the vending machine, and accepting instructions from users, or a window portion through which a product housing section that houses products can be visually confirmed. A product conveyor conveys product contained in the product housing section to a product dispensing slot provided at the product housing section.

15 Claims, 15 Drawing Sheets

(B)

(A)

(B)

(A)

(B)

(A)

(B)

(A)

(B)

(A)

(B)

VENDING MACHINE-INTEGRATED TABLE

FIELD OF THE INVENTION

The present invention pertains to a vending machine integrated table, and particularly with regard to a method of selling products, is a vending machine integrated table with a game function attached to automatically dispense product, or to sell product by causing the product to be acquired through manual operations by the user.

BACKGROUND OF THE INVENTION

Currently as vending machines, for example, vertical type vending machines are known, such as those disclosed in the patent document below. Conventional vending machines have a money insertion slot and product selection buttons located on an upper part of a perpendicular surface of the front surface of the vending machine, and have a product dispensing slot and a change dispensing slot located on a lower part thereof. Moreover, the format of conventional vending machines is such that product is replenished inside the main unit of the vending machine and inside a product stocker provided on a back surface of a door on the front surface of the vending machine. Accordingly, a user trying to purchase product from a vending machine inserts money while standing, selects a product, and next leans over to retrieve product from the lower product dispensing slot and to retrieve change from the change dispensing slot.

Patent Document 1: Japanese Unexamined Pat. App. Pub. No. 2002-133,492

DISCLOSURE OF INVENTION

Problem Invention is to Solve

As described above, vending machines as described in the prior art are formed with a visual appearance that is vertical for ease of manufacturing and ease of transport. Accordingly, conventional vending machines are often times installed outdoors, and even if installed indoors, the vending machines have to be installed at a wall surface or the like, and are not installed in the center of a room (of course, this is because the machine becomes an obstacle, if a vending machine is installed in the center of a room or the like).

That is, a dedicated area is required in order to install a vending machine, and if a predetermined area (vending machine dedicated area) facing the outdoors, a wall, or such cannot be secured, a conventional vending machine cannot be installed.

Meanwhile, vending machine installers such as beverage manufacturers who want to install vending machines have been requesting that vending machine installation sites be further increased.

SUMMARY OF THE INVENTION

Problem Invention is to Solve

In order to solve the above-mentioned issues, the present invention is premised on a vending machine integrated table provided with at least a top plate, and a vending machine beneath the top plate. The top plate is provided with one of either a displaying and accepting means for displaying products that can be sold by the vending machine, and accepting instructions from users, or a window portion through which a product housing section that houses products can be visually confirmed. Moreover, the vending machine is provided with a product conveying means for conveying product contained in the product housing section to a product dispensing slot provided at the product housing section.

By adopting a configuration that integrates a vending machine and a table as described above, a dedicated area for installing a vending machine, which is necessary with conventional technology, is not necessary, and as long as there is an area to install a table, the vending machine integrated table of the present invention can be installed in that area. Accordingly, the vending machine integrated table of the present invention can be installed even in a location where a conventional vending machine cannot be installed if a dedicated area cannot be secured for installing the vending machine along a wall surface or such.

In the above configuration, for a case in which a displaying and accepting means is provided in the top plate, it is desirable that an appearance of a product contained in the product housing section being conveyed to the product dispensing slot is displayed when the displaying and accepting means accepts instructions from a user. Further providing a display instruction means that provides instructions to the displaying and accepting means to display a product that can be sold by the vending machine is desirable in the above configuration.

The present invention can be configured to function as a vending machine when required by a user, by configuring it such that a desired initial screen is displayed or no screen is displayed when not used as a vending machine.

When a window portion is provided in the top plate in the above configuration, providing a shutter in the top plate that can change the product housing section between a visible state and a not visible state from the window portion is desirable. By configuring the table in this manner, the product housing section can be made not visible when the table is not being used as a vending machine, and the table can thereby be used exclusively as a table.

In the above configuration, it is desirable to further provide a rail on the inner circumference of the product housing section, and provide the product conveying means with a support and a holding means. Moreover, the support preferably moves along the rail by operations from the user, and the holding means preferably is provided so as to be moveable on the support, and is configured as suspended to allow movement up and down so as to be able to hold product contained in the product housing section.

If the above configuration is adopted, the user can operate the product conveying means, and first, the support with the suspended holding means is moved along the rail to near the product desired by the user. The holding means is then moved to a position directly above the product on the support. Moreover, the holding means is lowered to hold the product, and the held product is conveyed to the product dispensing slot provided in the product housing section.

In the above configuration, with a vending machine integrated table provided with a window portion in the top plate, it is desirable that the product housing section has a horizontal cross-section shape that is spherical, and is provided with a rail provided on the inner circumference of the product housing section, and that the product conveying means is equipped with a rotatable shaft, support, and holding means. The rotatable shaft is provided at the center of the product housing section, and is rotated by operation by the user. The support moves along the rail axially supported on the shaft, and has a length equivalent to a horizontal distance from the shaft to the rail. Moreover, the holding means preferably is provided so as to be moveable on the support, is suspended to allow movement up and down, and is configured as suspended to allow movement up and down so as to be able to hold product contained in the product housing section.

In the above configuration, the holding means can adopt a configuration that provides a pair of claw shaped members to grip the product. Alternatively, the holding means can adopt a configuration that provides a shovel shaped member to scoop up and grip the product. Moreover, the holding means can adopt a configuration that includes a pump, hose, and suctioning tool. In this case, the pump supplies and discharges air, and the hose is connected at one end to the pump. Moreover, a configuration can be adopted in which a suctioning tool is connected to the other end of the hose such that air can be supplied and discharged from the tip end through the hose by the operation of the pump, and product can be suctioned.

In the above configuration, if a window portion is provided in the top plate, a configuration can be adopted in which the product conveying means is provided with a conveyor lane and a push out means. In this case, the conveyor lane is a lane provided in the product housing section, and an endless conveyor is driven in a circulating manner. When the conveyor of the conveyor lane is driven in a cyclic manner, and product designated by the user from amongst the products arranged on the conveyor is conveyed to a position near the product dispensing slot, the push out means pushes out product near the product dispensing slot to the product dispensing slot.

Moreover, the product conveying means can adopt a configuration including a rotary shaft provided in the product housing section, a rotating plate, and a push out means. In this case, when the rotating plate is rotatably supported on the rotary shaft, the rotating plate rotates, and product designated by the user from amongst the products arranged on the rotating plate is conveyed to a position near the product dispensing slot, and the push out means pushes out product near the product dispensing slot to the product dispensing slot.

If the product targeted for vending is a cake or other dessert, or a food product that could suffer damage to the shape when gripped, scooped up, or suctioned by air by a holding means, the above food products may, for example, be inserted into a box or the like, and the box into which the food product is inserted may be arranged on the rotating plate. If a configuration is adopted that pushes out the box to the product dispensing slot when the rotating plate is rotated, and the box has moved to a position near the product dispensing slot, the product can be conveyed without damaging the shape thereof.

In the above configuration, a seat is preferably provided on a leg part of the table unit, and a configuration may be adopted in which the seat is provided such that it can rotate on the leg part.

As described above, by equipping the table unit with a seat, separation of the table unit and the seat (chair) is eliminated. Accordingly, when a vending machine integrated table of the present invention is used, after a user uses the vending machine integrated table of the present invention, there is no need to straighten up the chair that corresponds to the seat. Therefore, selling of products can be conducted by the vending machine integrated table of the present invention even when there are few service personnel serving users (customers) (may also be an unmanned vending without a service technician present).

An Effect of the Invention

According to the vending machine integrated table of the present invention, because a configuration is adopted in which a vending machine and a table are integrated, even if a location is such that a dedicated area cannot be secured for a vending machine, as is necessary with conventional technology, as long as there is an area in which a table can be installed, that area can be used as a dual purpose area, namely as an area for installing a vending machine and as an area for installing a table. Accordingly, even if a location is such that a dedicated area cannot be secured as is necessary with conventional vending machines, a vending machine integrated table of the present invention can be installed in an area in which a table can be installed.

DETAILED DESCRIPTION

Figure 1:
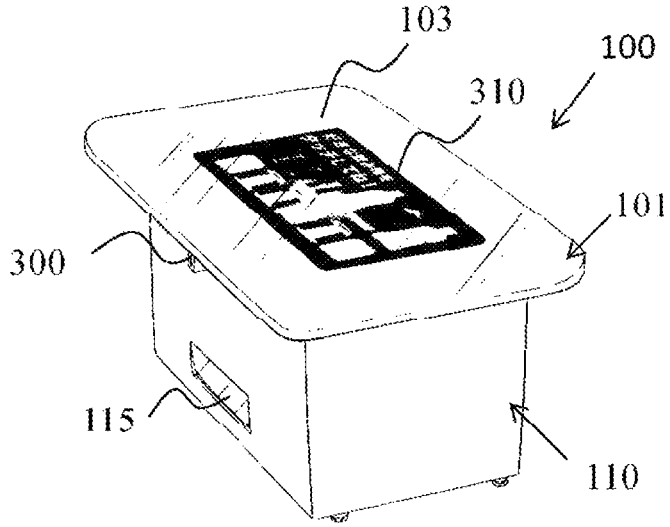
FIG. 1 is an illustration showing an overall configuration of a vending machine integrated table according to an embodiment of the present invention.
Figure 3:
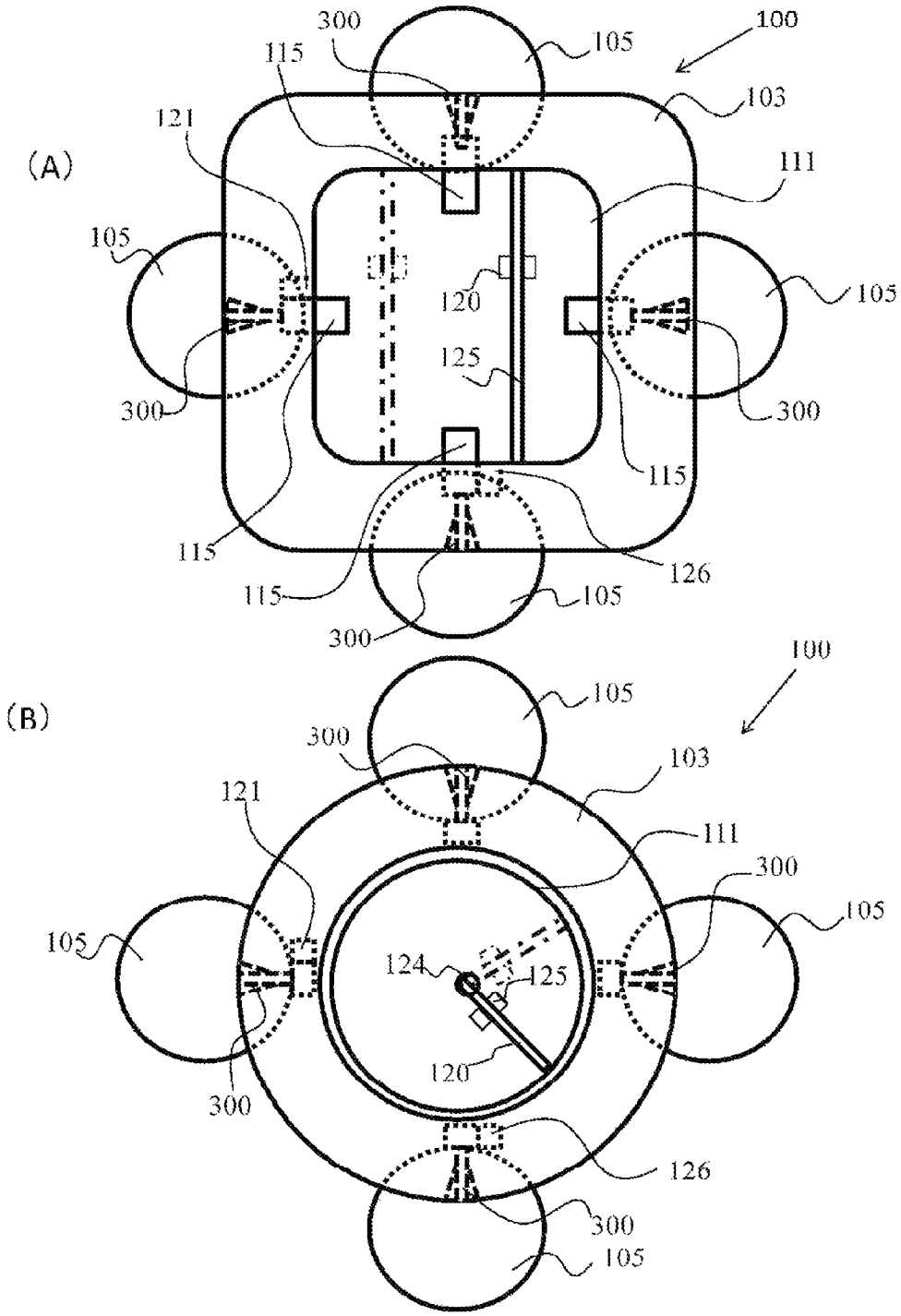
FIG. 3 is an illustration showing an operation unit provided on a side surface of the vending machine integrated table according to an embodiment of the present invention.

The basic process for conveying a product with a vending machine integrated table 100 of the present invention is described below. FIG. 1 is an outline view of the vending machine integrated table 100 of the present invention. However, details of portions that are not directly related to the present invention are omitted. When a user uses the vending machine integrated table 100 of the present invention to purchase a product, the user inserts paper currency or coins (may also of course be coins and the like uniquely stipulated by the installer of the vending machine integrated table 100) necessary to purchase a product into an insertion slot 330 shown in FIG. 3, and follows the instructions for purchasing product using the operation unit 300 provided underneath a top plate 103 of the vending machine integrated table 100. When the instructions are present, the selected product is retrieved by the operation of each part (drive section) shown below.

Namely, as shown in FIG. 1, the vending machine integrated table 100 of the present embodiment includes a table unit 101 and a vending machine 110 attached underneath the table unit 101. A configuration that provides a display panel 310 in a top plate 103 of the table unit 101 is adopted. For example, the display panel 310 may be configured with a touch panel, and a configuration can be adopted in which a user can press a product displayed in the display panel 310 to select a desired product.

The touch panel provided in the top plate 103 possesses a function to display product contained in a hereinafter described product housing section 111, a product selection button to select the product, characteristics of the product, and advertising related to the product, and a function to accept the pressing of a displayed product selection button. Namely, when a button (for example, the product selection button) in the screen displayed in the touch panel is pressed, the processing conditions associated with the pressed button are input.

A configuration may also be adopted in which, in addition to the product selection button, and the like, a video simulating the appearance of the product being conveyed is displayed in the touch panel. For example, a configuration displaying the appearance of the product being conveyed (described below) can also be adopted.

Figure 2:
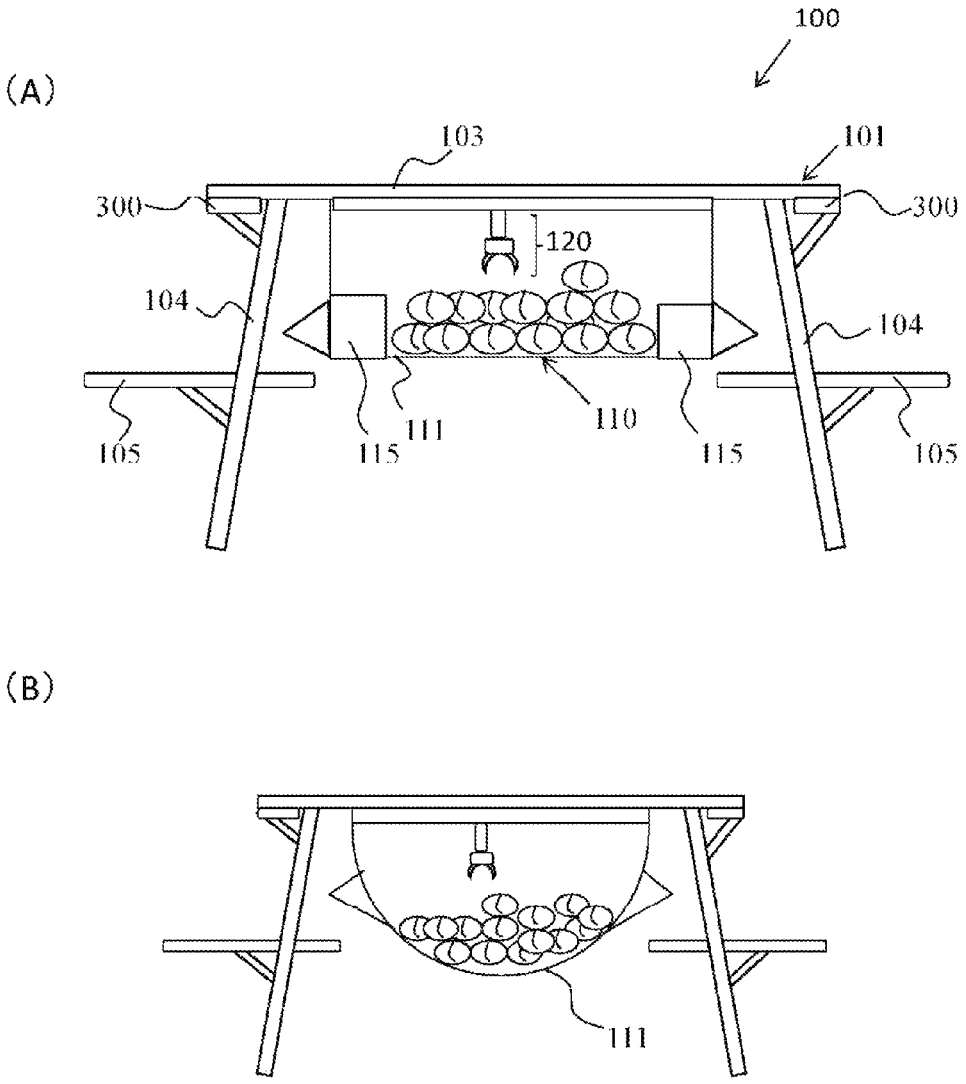
FIG. 2 is a top view of a vending machine integrated table according to an embodiment of the present invention.

A configuration providing a window portion in place of the display panel in the top plate 103, as shown in FIG. 2, can also be adopted. Namely, a configuration is adopted in which an opening is provided in the top plate 103 of the table unit 101, the opening and the product housing section 111 of the vending machine 110 are mated, and then a lid of the product housing section 111 is provided in this opening from the top portion of the top plate 103. Note that a configuration using a non-transparent lid may also be adopted such that the product housing section 111 is not visible, but in this embodiment, a configuration using a transparent lid such that the product can be visibly confirmed is adopted. The transparent lid corresponds to the window portion of the present invention. Moreover, the lid of the opening of the top plate may also be configured to be removable such that targeted product can be inserted and housed in the product housing section 111 from the opening of the top plate 103.

The top plate 103 of the table unit 101 is not restricted regarding a shape thereof, and the shape may be rectangular, or it may be circular as shown in FIG. 2(B). Note that a configuration providing in the top plate a shutter that can change the product housing section between a visible state and a not visible state from the window portion can be adopted. A configuration providing a plurality of leg parts 104 in the table unit 101 such that the top plate 103 is supported can also be adopted. In the above case, a seat 105 for sitting is secured to predetermined locations of the leg parts 104. In the present embodiment, a hole is opened in the seat 105 shaped with a pre-determined shape (for example, circular), and the seat 105 is secured to a leg part 104 by mating this hole with a leg part 104. A rotatable configuration with regards to the seat 105 and the leg part 104 may of course be adopted.

Figure 4:
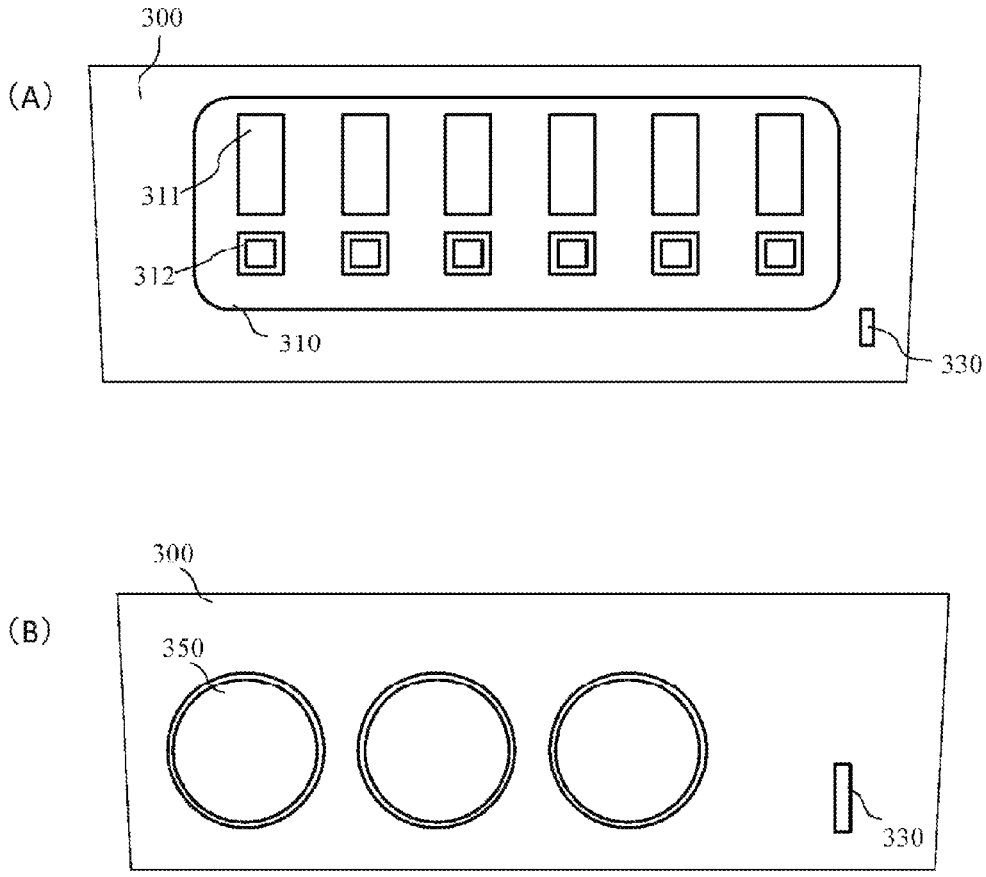
FIG. 4 is an illustration for a case in which an operation unit is provided on a top surface of the vending machine integrated table according to an embodiment of the present invention.
Figure 5:
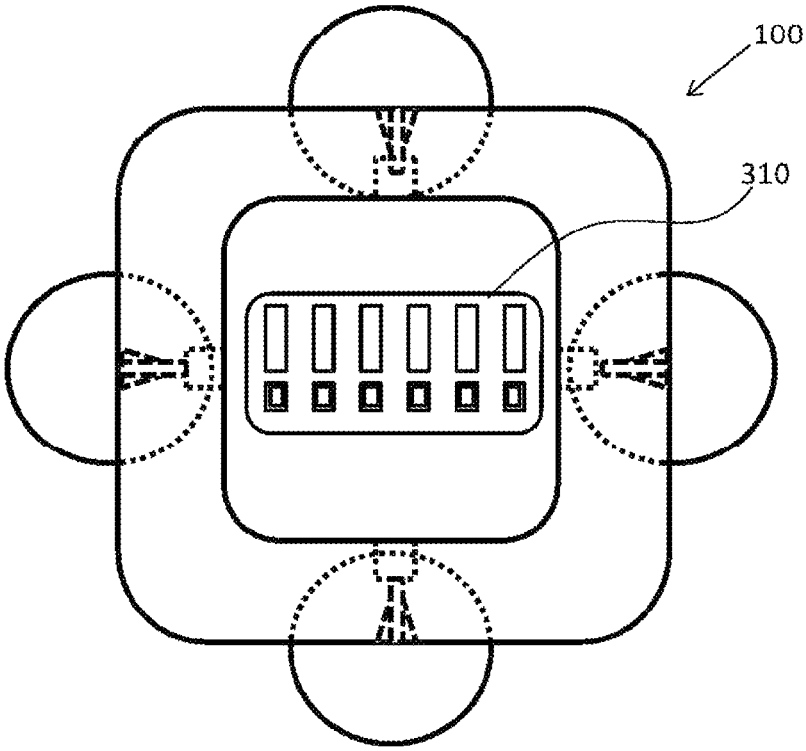
FIG. 5 is an illustration showing an overall configuration of a vending machine integrated table according to an embodiment of the present invention for a case in which a circular shaped product housing section is adopted.
Figure 5:
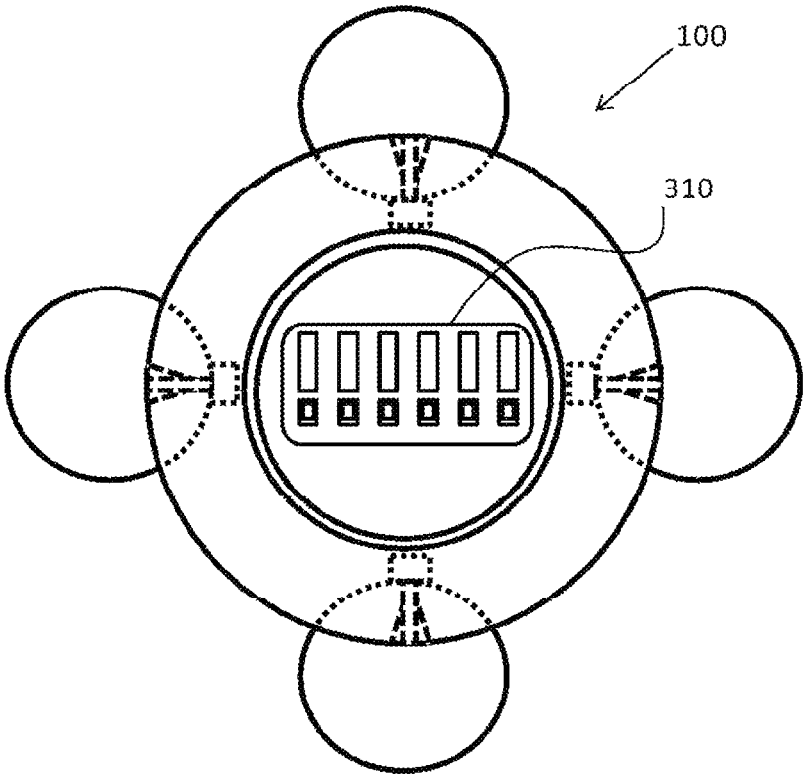

As shown in FIGS. 2 and 4, an operation unit 300 is provided near the perimeter of the top plate 103 of the table unit 101. The operation unit 300 is provided with the display panel 310, including a display part 311 to display product samples targeted for vending, and a product selection button 312 for selecting and purchasing product corresponding to the sample product, and with a money insertion slot 330 for general cash sales, a return lever (not illustrated), and the like. Note that as shown in FIG. 5, a configuration providing the operation unit 300 on the top surface of the top plate 103 may also be adopted.

Moreover, a product dispensing slot 115 for dispensing conveyed product is provided in the product housing section 111. The vending machine 110 provided under the table unit 101 includes the product housing section 111, a hereinafter described product conveying means 550, and the operation unit 300. The product housing section 111 is a container for housing product targeted for vending, and as shown in FIG. 2, a transparent container is used such that product contained in the product housing section 111 can be visibly confirmed from the exterior. The shape of the product housing section 111 may be any arbitrary shape, and in FIG. 2(A), a product housing section 111 having a rectangular parallelepiped shape is shown, and in FIG. 2(B), a product housing section 111 having a hemispheroidal shape is shown. Moreover, a product dispensing slot 115 for dispensing product conveyed by a hereinafter described product conveying means 550 is provided at a bottom part of a product housing section 111. Note that details of various parts that are generally and naturally necessary in a vending machine such as a mechanism to maintain temperature such that product is stored at a predetermined temperature are not relevant to the present invention, and thus descriptions and illustrations thereof are omitted.

As the method to convey a targeted product from the product housing section 111 to the product dispensing slot 115, the vending machine 110 may use a heretofore known vending machine conveying method, and may use a heretofore known method used in arcade game equipment like a method described below. Note that a configuration can be adopted in which a video, simulating the appearance of a product being conveyed by the product conveying means 550 adopted below, is displayed in the above-mentioned display panel 310 provided on the top plate 103 while the user is selecting a product, or the like.

Here, when one of the products contained in the above-mentioned product housing section 111 is selected according to designation by a user, it is the product conveying means 550 that conveys the selected product to the product dispensing slot 115 provided in the vending machine 110.

The product conveying means 550 can use, for example, an arm transfer mechanism for gripping product used in heretofore known arcade game equipment. The vending machine integrated table 100 shown in FIG. 3 includes an arm support transfer motor 126 for moving an arm support 125 that supports an arm 120, and an arm transfer motor 121 that moves an arm 120. Here, a rail (not illustrated) for moving the arm support 125 is provided on an upper inner perimeter of the product housing section 111. The arm support 125 moves on the rail.

A planar positioning operation is implemented by a drive transmission mechanism coupled to both of the above-mentioned transfer motors. First, the arm support 125 is moved in a depth direction of the vending machine integrated table 100 by the arm support transfer motor 126, or is moved along the rail from the right to the left in a lateral direction by the arm support transfer motor 126. Next, positioning of the vertical position of the arm is achieved by the arm transfer motor 121 moving the arm 120 along the arm support 125. Note that of the transfer mechanism of the above-mentioned arm 120, descriptions and illustrations are omitted for the belt member, pulley, and other parts ordinarily provided in the transfer mechanism. Note that a configuration can also be adopted in which a button 350 provided in the operation unit 300 shown in FIG. 4(B) is operated to move the above-mentioned arm support 125 and arm 120.

As shown in FIG. 3(B), when a circular shaped product housing section 111 (horizontal cross-sectional shape is circular) is adopted, a configuration for another transfer mechanism for the product conveying means 550 can be adopted. For example, by providing a shaft 124 in the center of a circular shaped product housing section 111, and rotating an arm support 125 that rotates centered on the shaft 124, initially, positioning is implemented in the circumferential direction of the product housing section 111. Next, positioning of the arm 120 in the radial direction can be performed by moving the arm 120 in the radial direction from the center of the arm support 125. Note that in the present embodiment, an arm support 125 having a length of the radius when viewing the product housing section 111 from the top (length equivalent to the horizontal distance from the shaft 124 to the rail) is used for the arm support 125. A configuration that journals one end of the arm support 125 to the shaft 124, and supports the other end by a rail provided in the product housing section 111 is adopted. Of course, an arm support 125 having a length of the diameter of the product housing section 111 can also be used.

Positioning of the arm support 125 in the circumferential direction of the product housing section 111 without providing the above-described shaft can also be implemented. For example, a driving wheel for moving on the above-mentioned rail is provided on both end portions of the above-mentioned arm support 125 (in this case, the arm support 125 has a length of the diameter portion of the product housing section 111) (the driving wheel is obviously provided at a position arranged on the rail). Moreover, the arm support 125 can be moved along the rail by driving the driving wheel.

Figure 6:
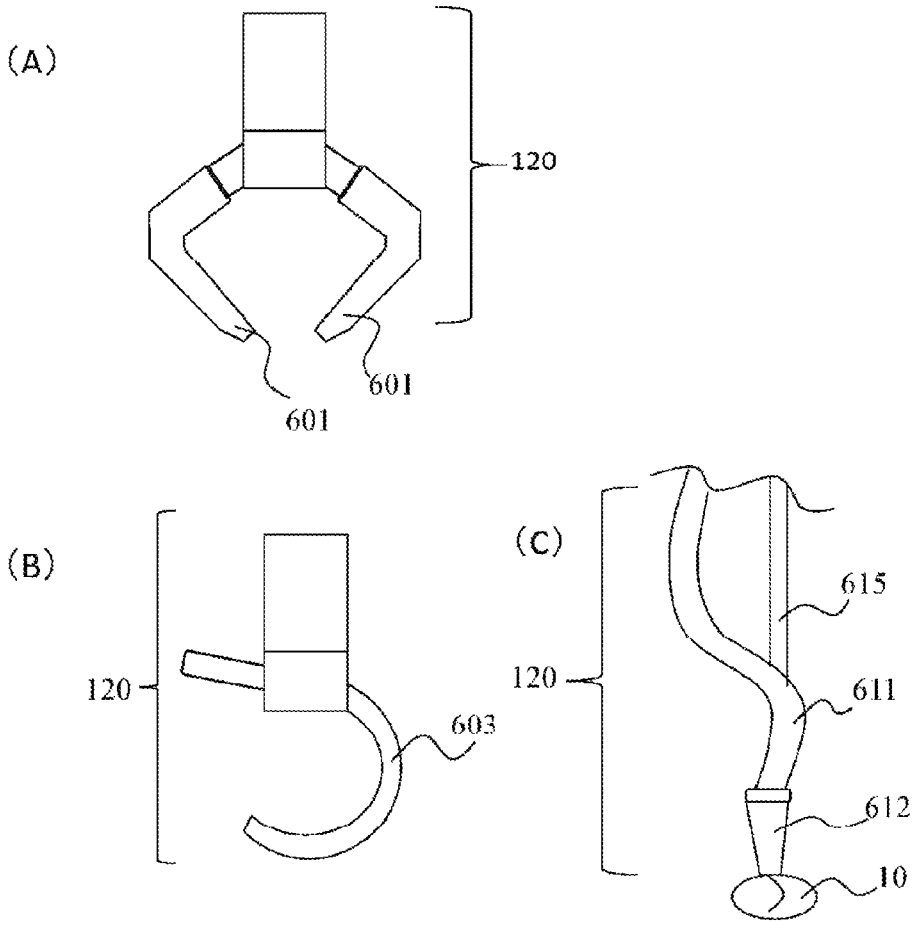
FIG. 6 is an illustration showing an arm shaped, shovel shaped, and pump mechanism type product conveying means for a vending machine integrated table according to an embodiment of the present invention.

Note that for the method for the arm 120 to grab the targeted product as well, a configuration in which an arm used in the heretofore known arcade game equipment mentioned above grabs a prize (corresponding to a targeted product of the present embodiment) can be adopted. For example, as shown in FIG. 6(A), claw shaped members 601, which grip or hook product, are attached to the leading end of the arm 120. Note that the arm 120 includes a motor as a power source, and an arm open and close mechanism (not illustrated) having a rack and pinion and the like in order to drive the opening and closing of the arm 120 based on the rotational output of the motor thereof, and opening and closing of the arm 120 is implemented based on the forward rotational drive or reverse rotational drive of the motor.

Moreover, as a configuration other than the arm 120, a configuration providing a shovel shaped member like that shown in FIG. 6(B) to scoop up and acquire (hold) product can also be adopted. In addition, as shown in FIG. 6(C), a pump mechanism 610 can also be used. For example, a suctioning tool 612 is provided at one end of a hose 611. The other end of the hose 611 is connected to a pump (not illustrated). Moreover, a configuration can be adopted in which air can be supplied and discharged from the tip end of the suctioning tool 612 through the hose by the operation of the pump, and product can be suctioned.

Moreover, for example, if a targeted product is attached to a magnet, a configuration can be adopted in which an electromagnet is adopted in place of the arm 120, and as a result, after positioning of the electromagnet is performed as described above, the targeted product sticks to the electromagnet by passing an electric current through the electromagnet. In addition, when conveying a targeted product for which the shape thereof could easily be damaged by gripping or hooking the product, as is the case with cake or the like (of course, the product housing section contains a box in which the cake or the like is inserted (referred to hereafter as merely box)), a measure such as the following is implemented, and the box can be conveyed from the product housing section to the product dispensing slot.

Figure 7:
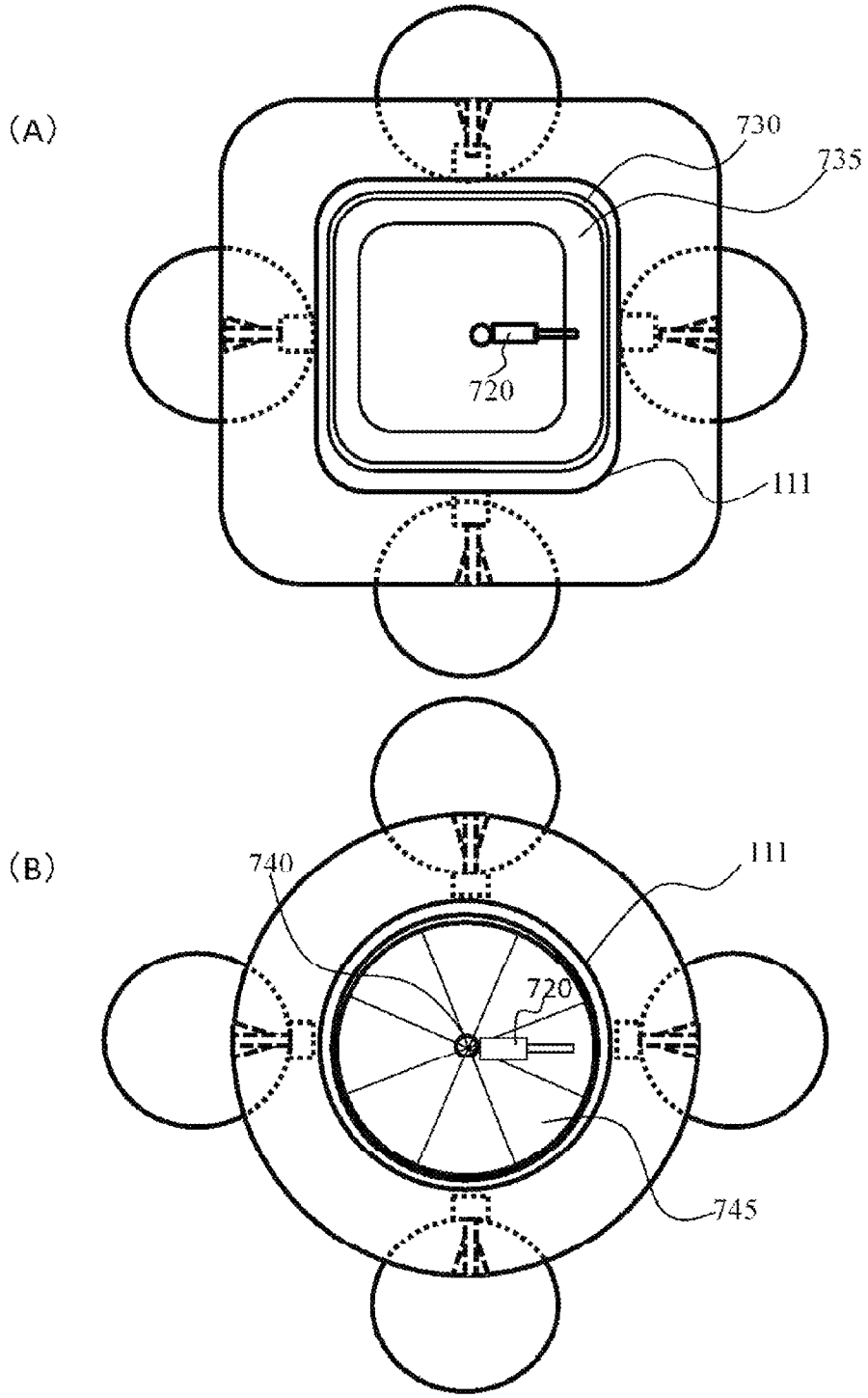
FIG. 7 is an illustration showing a product conveying means equipped with a push out means for a vending machine integrated table according to an embodiment of the present invention.

Namely, as shown in FIG. 7(A), for example, a conveyor rail 730 is provided on the product housing section 111 (if a shape having a hereinafter described conveyor 735 disposed, the shape thereof may be an arbitrary shape). The conveyor rail 730 is configured such that an endless conveyor 735 is driven in a circulating manner thereon. A product having a shape that is easily damaged like a cake box (may also of course be a product having a shape that is not easily damaged) is arranged on the conveyor 735. Moreover, an expandable and contractable push out means 720 is provided at the product housing section 111 to push out product near the product dispensing slot to the product dispensing slot when the conveyor 735 of the conveyor rail 730 is driven in a cyclic manner, and a product designated by the user from amongst the products arranged on the conveyor 735 is conveyed to a position near the product dispensing slot. In the present embodiment, the push out means 720 is provided near the center of the product housing section 111.

Moreover, FIG. 7(B) shows another embodiment provided with the above-mentioned push out means 720. First, the product housing section 111 is formed in a circular shape, and a rotary shaft 740 is provided in the product housing section 111. Further, a rotating plate 745 is rotatably supported on the rotary shaft 740. A predetermined number of the above described cake boxes are arranged on the rotating plate 745. In the present embodiment, a configuration is adopted in which the circumference of the rotating plate 710 is divided into a plurality of zones, and boxes containing cake or the like are arranged in each of the divided zones.

Moreover, the push out means 720 is provided near the center of the rotating plate 710. When the above-mentioned box (needless to say, a box specified by the user) is conveyed from its pre-determined position to a position near the product dispensing slot 115, this push out means 720 moves the box to the product dispensing slot 115 by pushing out the box. The above-mentioned push out means 720 may adopt a configuration that provides push out means 720 at each position facing each product dispensing slot 115 (position corresponding to near the center of the rotating plate 710) such that a box conveyed to the front of the product dispensing slot 115 can be moved to the product dispensing slot 115. Alternatively, a configuration may be adopted in which the above-mentioned push out means 720 is configured such that the above-mentioned rotary shaft 701 is rotatable as a shaft, and when a box is conveyed to a position near one of the product dispensing slots 115, the push out means 720 rotates about the rotary shaft 701, and moves to a position facing the given product dispensing slot 115.

As described above, when a push out means 720 is configured, the above-mentioned rotating plate 710 rotates, and when a product specified by a user from amongst the products arranged on the rotating plate 710 is conveyed to a position near one of the product dispensing slots 115 (for example, a product dispensing slot 115 nearest the operation unit 300 operated by the user), the product near the product dispensing slot 115 can be pushed out to the product dispensing slot 115.

Figure 8:
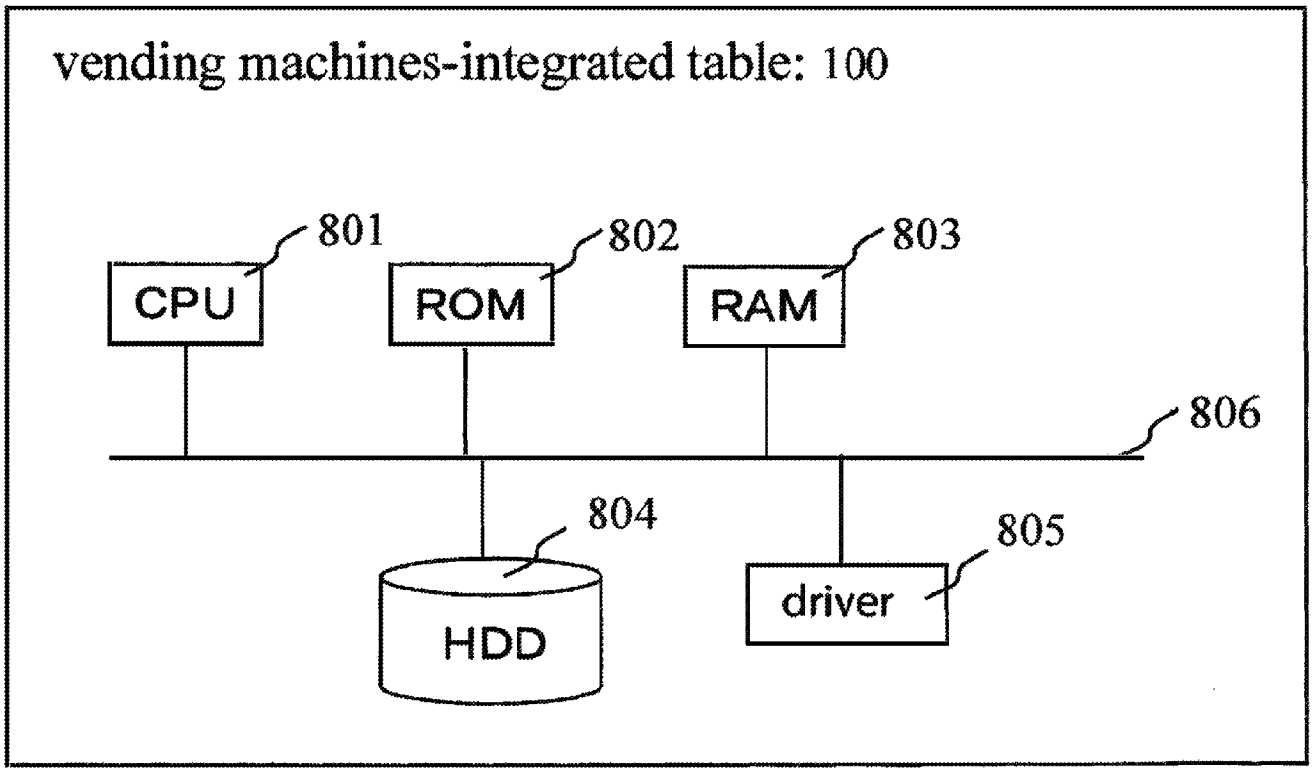
FIG. 8 is an illustration showing the architecture for the control system hardware of a vending machine integrated table according to an embodiment of the present invention.

Next, the architecture of the control system hardware of the vending machine integrated table 100 of the present invention is described using FIG. 8. FIG. 8 is a schematic block diagram of the control system hardware of the vending machine integrated table 100. However, details of portions that are not directly related to the present invention are omitted. The control circuit of the vending machine integrated table 100 connects the CPU (Central Processing Unit) 801, ROM (Read Only Memory) 802, RAM (Random Access Memory) 803, HDD (Hard Disk Drive) 804, and drivers 805 corresponding to each drive section by an internal bus 806. The CPU 801, for example, executes programs stored on the ROM 802, HDD 804, and the like using the RAM 803 as the operation domain, transmits and receives data and instructions from the drivers 805 and operation unit based on the execution results, and controls the operation of each drive section and the like shown in FIG. 8.

Processing Flow 1 when Product is Conveyed

Figure 9:
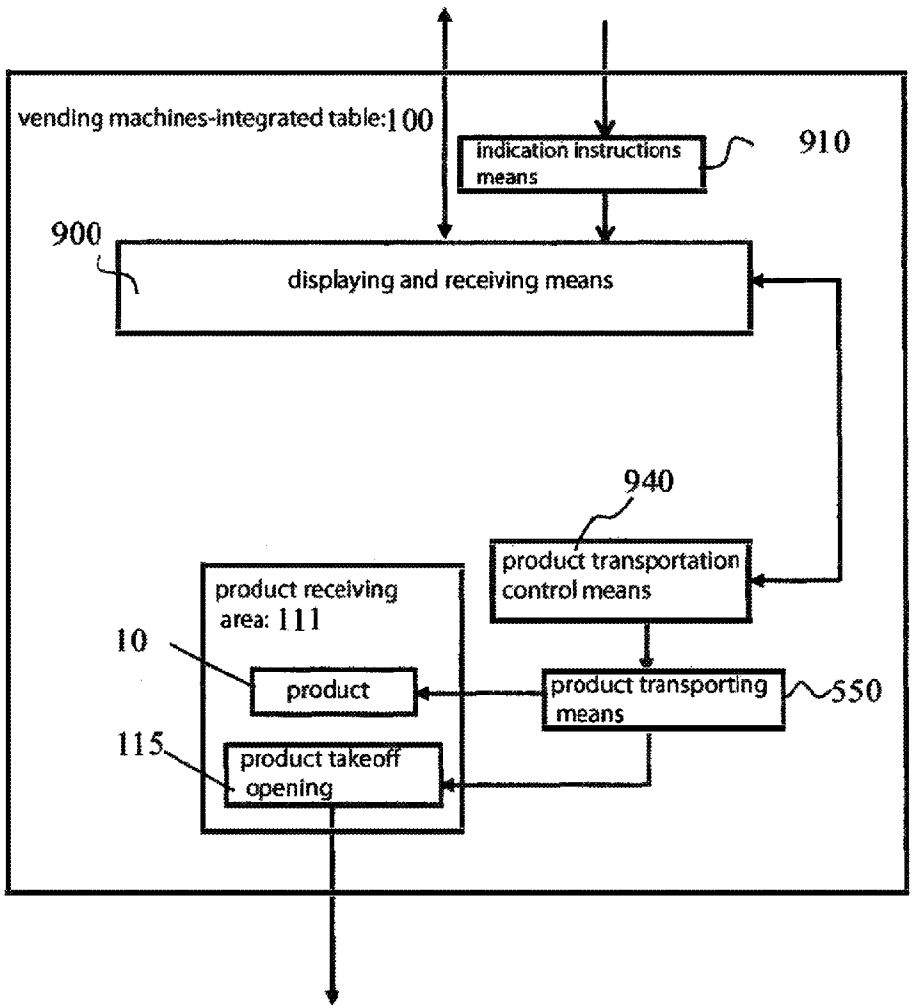
FIG. 9 is a functional block diagram of a vending machine integrated table according to an embodiment of the present invention.
Figure 10:
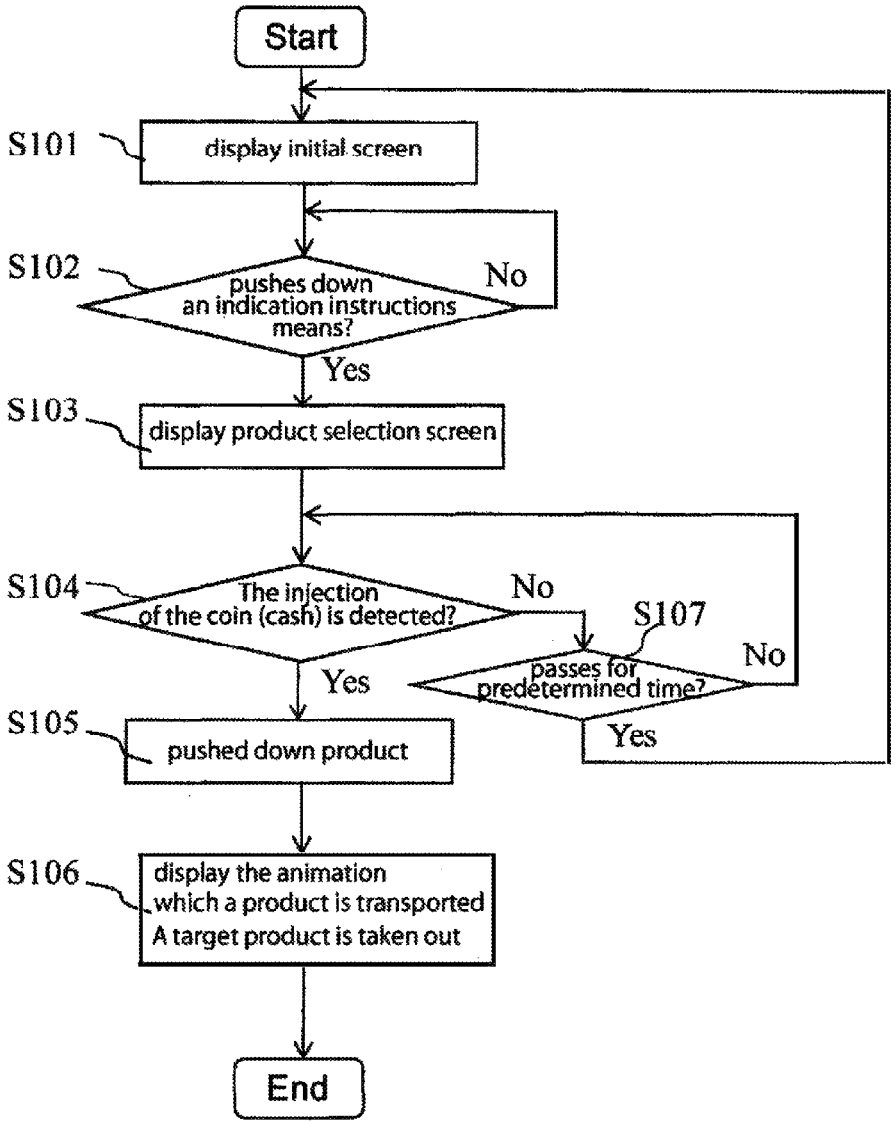
FIG. 10 is a processing flow chart showing the processing flow when product is acquired from a vending machine integrated table according to an embodiment of the present invention.

Next, the processing that occurs during product conveyance of the vending machine integrated table 100 of the present invention is described while referencing the figures. FIG. 9 is a functional block diagram of the vending machine integrated table 100 of the present invention, and FIG. 10 is a flow chart showing the processing that occurs during product selection with the vending machine integrated table 100 of the present invention. Note that S shown in FIG. 10 means step.

Figure 11:
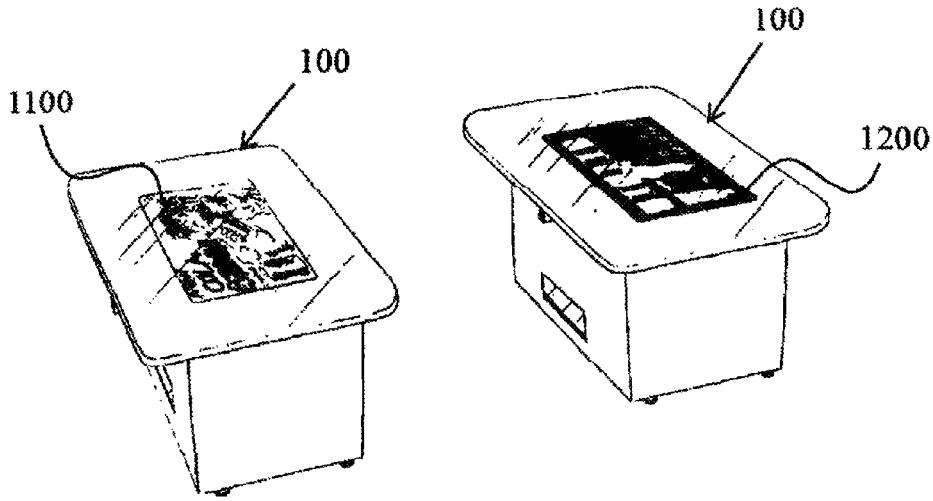
FIG. 11 is an illustration showing an example of a screen displayed in the top plate of a vending machine integrated table according to an embodiment of the present invention.
Figure 11:
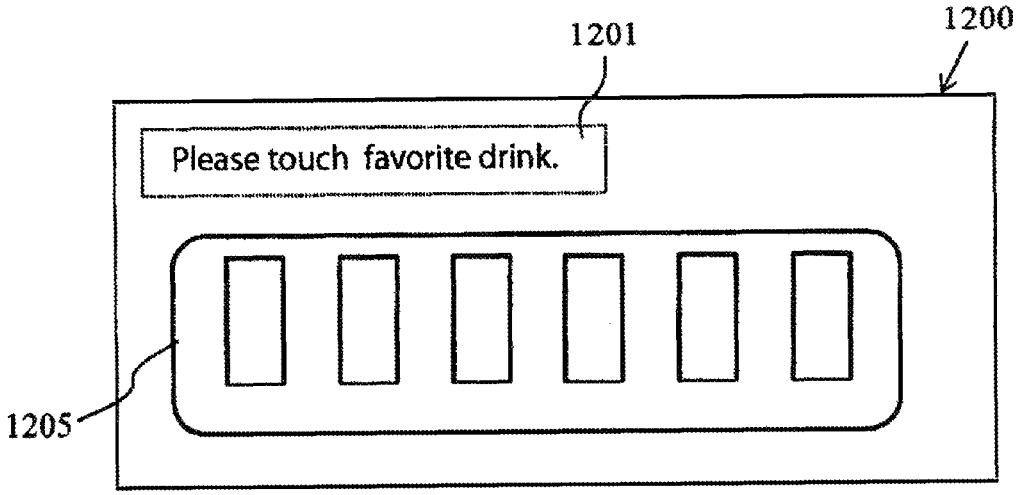

First, a displaying and accepting means 900 displays an initial screen 1100 in the display panel 310 provided in the top plate 103 (FIG. 10: S101). The initial screen 1100 may display an arbitrary still image or video. Alternatively, a configuration that does not display an image may be adopted, such as when used as a table. In the present embodiment, a configuration displaying an advertisement video shown in FIG. 11 as the initial screen 1100 is adopted. When a user wanting to purchase a product presses a selector switch (can adopt a configuration providing the selector switch on the operation unit 300 on the back side of the top plate 103) provided on the vending machine integrated table 100 of the present invention, a display instruction means 910 receives this input (FIG. 10: S102 YES), and notifies the displaying and accepting means 900 to display the product selection screen. Note that in place of the selector switch, for example, a configuration can be adopted in which the insertion of money (described hereinafter) and the like by the user into the money insertion slot provided on the back side of the top plate 103 is detected, and the display instruction means 910 notifies the displaying and accepting means 900 to display the product selection screen.

As described above, when the display instruction means 910 provides notification to display the product selection screen 1200, the displaying and accepting means 900 switches the currently displayed initial screen 1100 to the product selection screen 1200 that enables the purchase of products (FIG. 10: S103). A message 1201 adapted to product selection by the user, and a product video 1205 simulating product that can be purchased are displayed in the product selection screen 1200.

When the user decides on the product he or she wants to purchase from the product selection screen 1200, and then inserts money (in place of money, may also be a predetermined type of coin or the like stipulated by the installer of the vending machine integrated table 100) into the above-mentioned money insertion slot (FIG. 10: S104) to enable purchase of the determined product, the displaying and accepting means 900 makes it possible to press (enables purchasing of) a product image corresponding to products that can be purchased within the scope of the money that was inserted. For example, the displaying and accepting means lights a backlight for images of product that can be purchased to enable purchase of the above-mentioned products.

Next, when the user presses a product image 1205 corresponding to a product he or she wants to purchase, the displaying and accepting means 900 receives this input (FIG. 10: S105), and notifies a product convey control means 940 to convey the pressed product to the product dispensing slot 115. When the product convey control means 940 receives this notification, it controls the product conveying means 550 so that a product 10 is conveyed to the product dispensing slot. At this time, a configuration is adopted in which the displaying and accepting means 900 displays in the display panel a video showing the appearance of the product being conveyed from the product housing section 111 to the product dispensing slot 115 (FIG. 10: S106→End). The displaying and accepting means 900 displays the above-mentioned video in the display plan by referencing a video memory means that has stored the video in memory.

Note that when the product selection screen 1200 is displayed, and money or the like is not inserted even after a predetermined amount of time has passed, the displaying and accepting means 900 switches the above-mentioned product selection screen 1200 to the initial screen 1100 (FIG. 10: S104 NO→S107→S101).

Processing Flow 2 when Product is Conveyed

In the above processing flow 1, a configuration that automatically conveys a targeted product 10 contained in the product housing section 111 to the product dispensing slot 115 was adopted. In contrast, a configuration can also be adopted in which product 10 is conveyed to the product dispensing slot 115 by user operations (manual operations).

Figure 12:
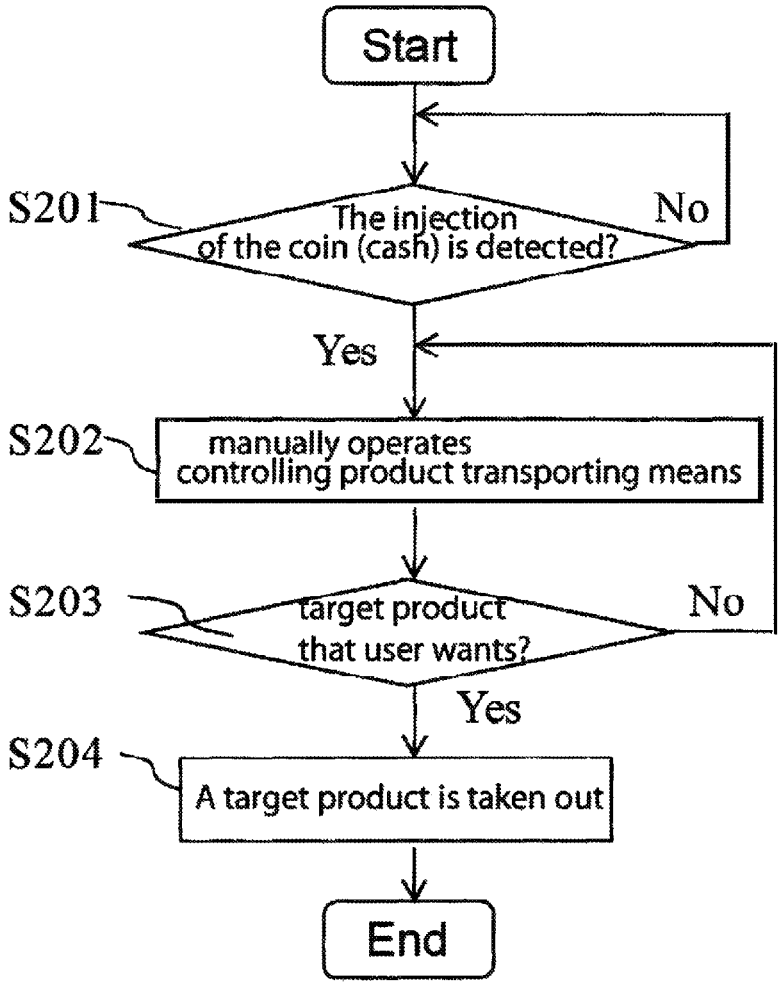
FIG. 12 is a processing flow chart showing the processing flow when product is acquired from a vending machine integrated table according to an embodiment of the present invention.

The vending machine integrated table 100 of the present embodiment is provided with a window portion that enables visible confirmation of the product housing section from the top plate 103. When a user wanting to purchase a product inserts money into a money insertion slot similar to Embodiment 1 (FIG. 12: S201 YES), the displaying and accepting means 900 receives this input, and makes it possible to control the above-mentioned product conveying means 550. The user then manually operates an operation unit (corresponds to the product convey control means 940) to control the above-mentioned product conveying means 550 provided in the displaying and accepting means 900 (FIG. 12: S202). The product conveying means 550 is notified of a control signal from the operation unit, and upon receiving this notification, the product conveying means 550 conveys a product 10 to the product dispensing slot through operations by the user (FIG. 12: S203 YES→S204→End). In this case, a configuration can be adopted that enables operation of the product conveying means 550 any number of times until the pre-determined product is acquired (FIG. 12: S203 NO→S202).

Others

Figure 13:
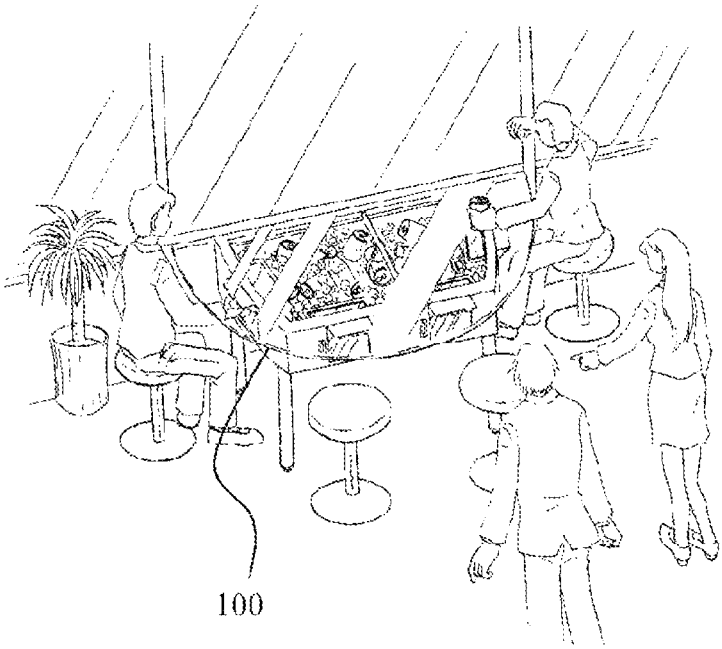
FIG. 13 is an illustration showing a usage state of a vending machine integrated table according to an embodiment of the present invention.
Figure 13:
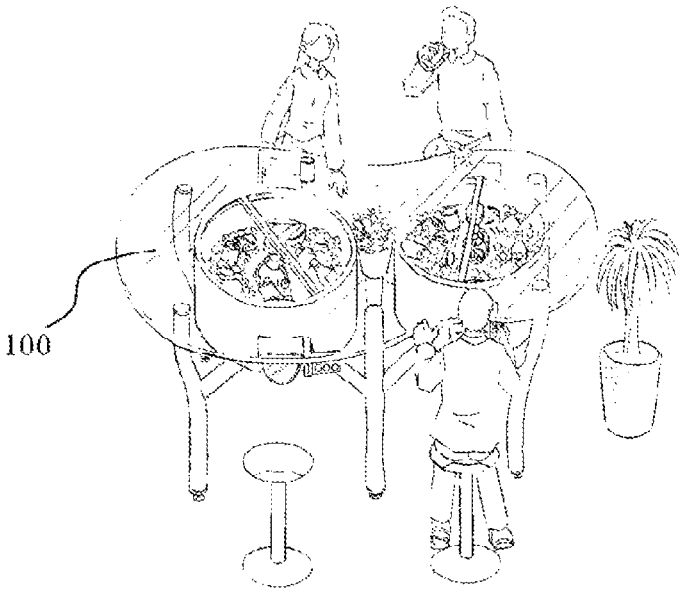
Figure 14:
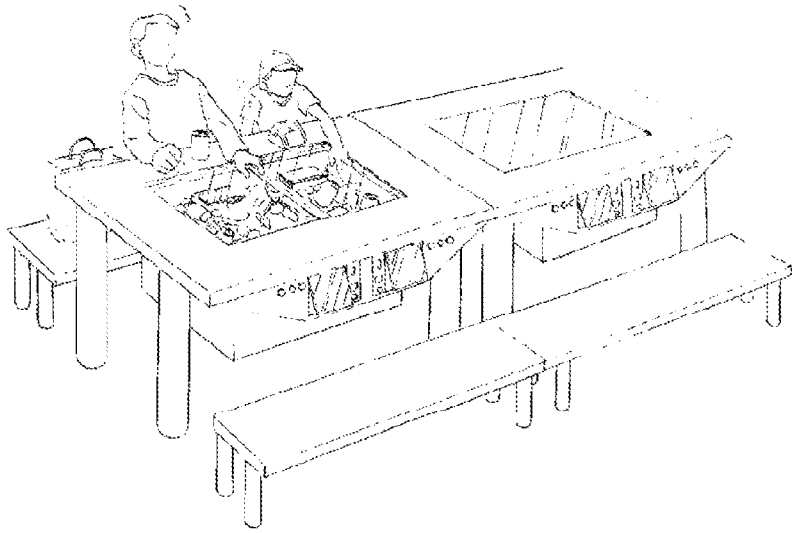
FIG. 14 is an illustration showing a usage state of a vending machine integrated table according to an embodiment of the present invention.
Figure 14:
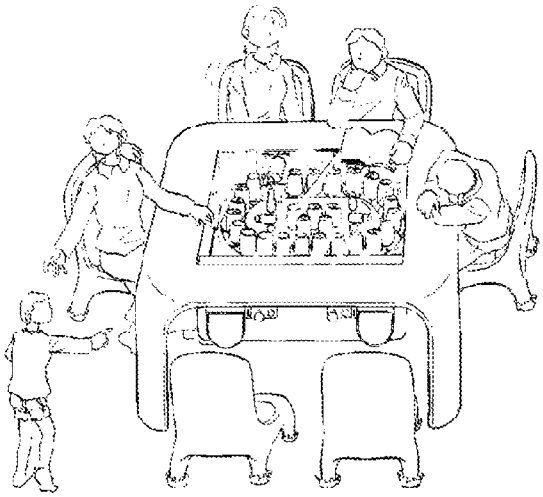
Figure 15:
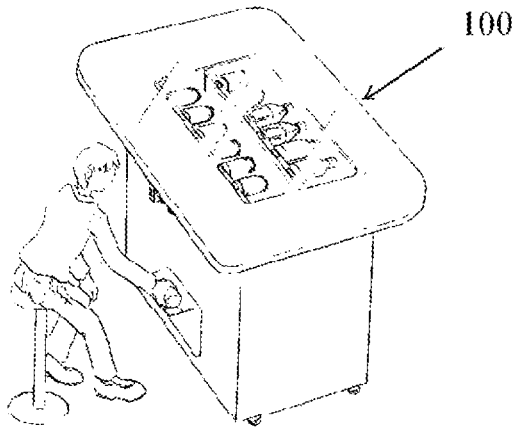
FIG. 15 is an illustration showing a usage state of a vending machine integrated table according to an embodiment of the present invention.
Figure 15:
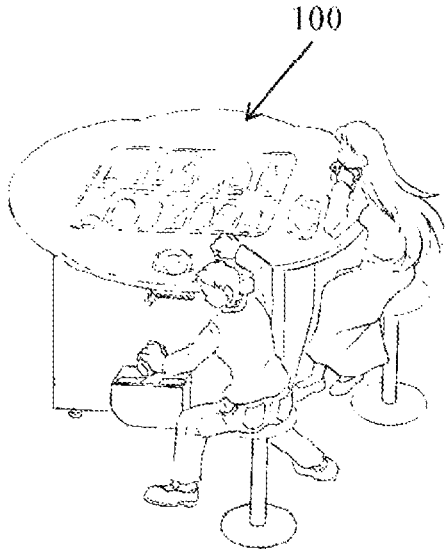

FIGS. 13 to 15 are illustrations showing usage states of vending machine integrated tables 100 of the present invention. Because the vending machine integrated table 100 of the present invention can be used as a table, the top plate 103 of the vending machine integrated table 100 can be used to eat a meal, as shown in FIGS. 13(A) and (B), or the vending machine integrated table 100 can be enjoyed as arcade game equipment to acquire product (meaning to convey product to the product dispensing slot), as shown in FIGS. 14(A) and (B). Moreover, as shown in FIGS. 15(A) and (B), the vending machine integrated table 100 can obviously be used as a vending machine.

INDUSTRIAL APPLICABILITY

Because the present invention is configured as a vending machine integrated with a table unit, a dedicated area for installing a vending machine is not necessary. An area for only installation of a table unit can also be used as an area to install a vending machine. Therefore, if area only for installation of a table unit can be secured, the vending machine can be installed, and thus the present invention is beneficial to users wanting to install a vending machine. Accordingly, the industrial applicability thereof is large.

DESCRIPTION OF THE REFERENCE NUMERALS

100: vending machines-integrated table
101: table unit
103: top plate
110: vending machine
111: product housing section
104: leg part
105: seat
115: product dispensing slot

The invention claimed is:

1. A vending machine-integrated table, comprising:
a table unit having at least a top plate; and
a vending machine under the top plate, wherein the vending machine includes:
a single, undivided product housing section for accommodating products, the product housing section having a product dispensing slot; and
product conveying means for conveying products accommodated in the product housing section into the product dispensing slot provided in the product housing section;
wherein the top plate has provided therein one of displaying and accepting means for displaying products which can be sold by the vending machine and accepting instructions from users, and a window portion through which users can view the product housing section and visually confirm the products in the product housing section.

2. The vending machine-integrated table of claim 1, wherein the top plate is provided with displaying and accepting means, and the displaying and accepting means displays an appearance of a product contained in the product housing section being conveyed to the product dispensing slot when the displaying and accepting means receives instructions from a user.

3. The vending machine-integrated table of claim 2 further comprising display instructions means for providing instructions to the displaying and accepting means to display products which can be sold by the vending machine.

4. The vending machine-integrated table of claim 1, wherein the top plate is provided with a window portion and the product housing section has an inner circumference, the vending machine-integrated table further comprising a rail provided on the inner circumference of the product housing section; and
wherein the product conveying means includes:
a support movable along the rail by operations from the user; and
holding means for holding a product contained in the product housing section, the holding means being movable on the support, and suspended to allow movement up and down.

5. The vending machine-integrated table of claim 4 wherein the holding means comprises a pair of claw-shaped members for gripping the product.

6. The vending machine-integrated table of claim 4 wherein the holding means comprises a shovel-shaped member for scooping up and gripping the product.

7. The vending machine-integrated table of claim 4 wherein the holding means comprising:
a pump that supplies and discharges air,
a hose connected at one end to the pump:
a suctioning tool connected to another end of the hose, such that air can be supplied to and discharged from a tip end thereof through the hose by the operation of the pump, and a product can be suctioned.

8. The vending machine-integrated table of claim 1, wherein the top plate is provided with a window portion, wherein the product housing section has an inner circumference, and wherein the horizontal sectional shape of the product housing section is circular;
the vending machine-integrated table further comprising a rail provided on the inner circumference of the product housing section;
wherein the product conveying means includes:
a shaft provided at the center of the product housing section, the shaft being rotatable by operation of the user;
a support rotatably supported on the shaft, the support being movable along the rail, and having a length equivalent to the horizontal distance from the shaft to the rail; and
holding means for holding a product contained in the product housing section, the holding means being movable on the support, and suspected to allow movement up and down.

9. The vending machine-integrated table of claim 1 wherein the top plate is provided with a window portion, and wherein the product conveying means comprises:
a conveyer rail provided in the product housing section, and having an endless conveyer driven in a circulating manner;
push out means for pushing out a product near the product dispensing slot to the product dispensing slot when the conveyor of the conveyor rail is driven in a cyclic manner, and a product designated by a user from amongst the products arranged on the conveyor is conveyed to a position near the product dispensing slot.

10. The vending machine-integrated table of claim 1 further comprising a leg part provided on the table unit, and a seat provided on the leg part.

11. A vending machine-integrated table, comprising:
a table unit having at least a top plate, the top plate having provided therein a window portion;
a vending machine under the top plate, wherein the vending machine includes:
a product housing section for accommodating products, the product housing section having an inner circumference and a product dispensing slot, and the product housing section and the products accommodated therein being viewable through the window portion;
a rail provided on the inner circumference of the product housing section; and
product conveying means for conveying products accommodated in the product housing section into the product dispensing slot provided in the product housing section, wherein the product conveying means includes:

a support movable along the rail by operations from the user; and holding means for holding a product contained in the product housing section, the holding means being movable on the support, and suspended to allow movement up and down.

12. The vending machine-integrated table of claim 11 wherein the holding means comprises a pair of claw-shaped members for gripping the product.

13. The vending machine-integrated table of claim 11 wherein the holding means comprises a shovel-shaped member for scooping up and gripping the product.

14. The vending machine-integrated table of claim 11 wherein the holding means comprising:

a pump that supplies and discharges air;

a hose having first and second ends, the first end being connected to the pump;

a suctioning tool connected to the second end of the hose, such that air can be supplied to and discharged from a tip end thereof through the hose by the operation of the pump, and a product can be suctioned.

15. A vending machine-integrated table, comprising:

a table unit having at least a top plate, the top plate having provided therein a window portion;

a vending machine under the top plate, wherein the vending machine includes:

a product housing section for accommodating products, the product housing section having an inner circumference and a product dispensing slot, and the product housing section and the products accommodated therein being viewable through the window portion;

a rail provided on the inner circumference of the product housing section; and product conveying means for conveying products accommodated in the product housing section into the product dispensing slot provided in the product housing section, wherein the product conveying means includes:

a shaft provided at the center of the product housing section, the shaft being rotatable by operation of the user;

a support rotatably supported on the shaft, the support being movable along the rail, and having a length equivalent to the horizontal distance from the shaft to the rail; and holding means for holding a product contained in the product housing section, the holding means being movable on the support, on the support, and suspected to allow movement up and down.

* * * * *